US005081724A

United States Patent [19]

Takahashi et al.

[11] Patent Number: 5,081,724

[45] Date of Patent: Jan. 21, 1992

[54] FOLDING BABY BED

[75] Inventors: Takehiko Takahashi, Tokyo; Yuji Shimizu, Aichi, both of Japan

[73] Assignee: Combi Corporation, Tokyo, Japan

[21] Appl. No.: 524,940

[22] Filed: May 18, 1990

[30] Foreign Application Priority Data

Aug. 21, 1989 [JP] Japan ..... 1-96757[U]

[51] Int. Cl.[5] ..... A47C 14/40; A47D 7/00

[52] U.S. Cl. ..... 5/136; 108/38; 108/42

[58] Field of Search ..... 5/133, 136, 424, 9.1, 5/94, 93.1, 93.2; 312/248; 108/38, 42, 152, 134

[56] References Cited

U.S. PATENT DOCUMENTS 4,613,996 9/1986 Chase et al. ..... 5/136
4,876,970 10/1989 Bolduc ..... 312/248
4,965,896 10/1990 Berger et al. ..... 5/424

FOREIGN PATENT DOCUMENTS 61-100298 6/1986 Japan .
1101928 4/1989 Japan .

OTHER PUBLICATIONS

"Bedlift ®" A Trade Brochure from the Mäfle Co., 1988.

"Baby Changing Station" an add on page 10 of the Oct. 1988 Issue of Small World Magazine.

*Primary Examiner*—Alexander Grosz
*Attorney, Agent, or Firm*—Sughrue, Mion, Zinn, Macpeak & Seas

[57] ABSTRACT

A folding baby bed has a vertically-long rectangular housing frame body portion which can be fixedly attached to a wall surface, a floor surface, or the like, at a back or bottom portion of the housing frame, and a bed portion provided at a frontal upper half portion of the housing frame body portion, the bed portion being pivotally attached to the housing frame body portion at opposite sides so that the bed portion can be horizontally extended and vertically folded so as to be housed in the housing frame body portion. When the bed portion is either in a vertically folded state or in a horizontally extended state, the state can be safely maintained by a supporting spring.

4 Claims, 3 Drawing Sheets

FOLDING BABY BED

BACKGROUND OF THE INVENTION

The present invention relates to a folding baby bed for use when the baby is to be laid down for a short time or when a diaper or clothes of a baby is to be changed in a public space, particularly in a public lavatory or toilet or the like.

In the case where a woman who goes out with a baby, specifically a very young baby and the woman wants to use a public lavatory or toilet or the like or wants to change the diaper or clothes of the baby, the woman sometimes experiences much inconvenience in that typically there is no space suitable for keeping the accompanying baby in an unattended state or for changing a diaper with the baby laid down.

In order to cope with these problems, baby circles i.e., body bed, or the like for laying down babies therein have been recently prepared in lavatories or toilets of department stores, railway stations, and so on. In this regard, the following problems occur. That is, since such a baby circle is so large in its size, the area occupied by the baby circle in the toilet room becomes large. Further, since the baby circle per se can not be folded, a large space is always required for providing the baby circle therein, even during an unused time thereby making the effective area in the toilet room narrow. As result, there are typically limitations in space for setting up such a baby circle therein.

SUMMARY OF THE INVENTION

It is therefore an object of the present invention to solve the above problems.

It is another object of the present invention to provide a folding baby bed which can be easily mounted and used (in practice) unused narrow space such as a corner portion of a lavatory or toilet or the like, and the bed portion of which can be folded in the unused space so that the area occupied by the baby bed can be made extremely small.

It is a further object of the present invention to provide a baby bed in which a baby laid down on the bed can be safely controlled.

In order to attain the above objects, the folding baby bed according to the present invention comprises a vertically-long rectangular housing frame body portion which can be fixedly attached at the back or bottom portion of the housing frame to a wall surface, a floor surface, or the like, and a bed portion provided at the frontal upper half portion of the housing frame body portion, the bed portion being pivotally attached to the housing frame body portion at the opposite sides of the base end portion of the bed portion, so that the bed portion can be horizontally extended and vertically folded so as to be housed in the housing frame body portion. When the bed portion is either in the vertically folded state or in the horizontally extended state, the state can be safely maintained by maintaining means.

BRIEF DESCRIPTION OF THE DRAWINGS

Other features and advantages of the present invention will be apparent from the following description taken in connection with the accompanying drawings, wherein.

DETAILED DESCRIPTION OF PREFERRED EMBODIMENTS OF THE INVENTION

Referring to the accompanying drawings, embodiments of the folding baby bed according to the present invention will be described hereunder.

FIGS. 1 through 5 show an embodiment of the folding baby bed according to the present invention. The folding baby bed is arranged such that a housing frame body portion A is assembled with a bed portion B pivoted on the housing frame body portion A, so that the bed portion B can be vertically folded to be housed in the housing frame body portion A, and horizontally extended from the frame body portion A.

Figure 4:
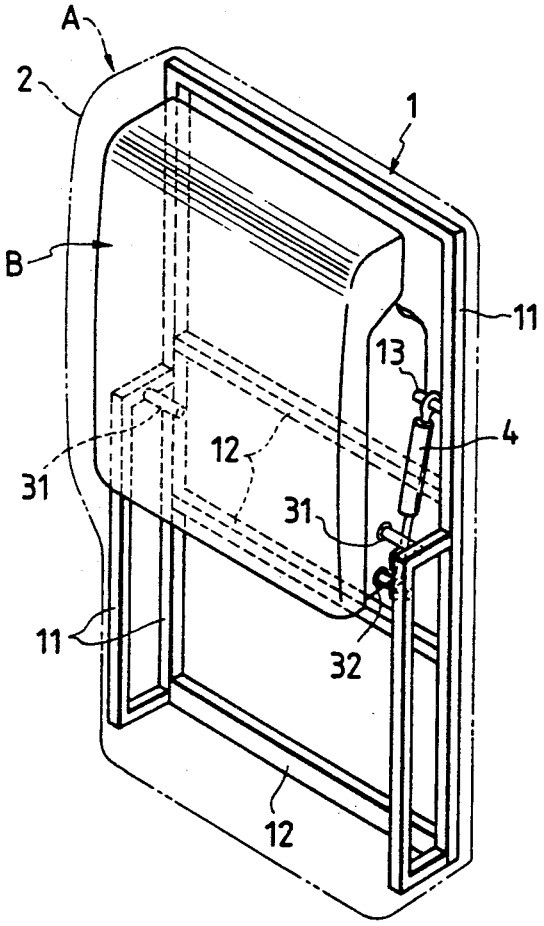
FIG. 4 is a perspective view showing the state where the cover body used on the housing frame body portion in FIG. 1 is removed.

As shown in FIG. 4, the housing frame body portion A is constituted by a substantially rectangular body portion 1 and a cover body portion 2. The body portion 1 is constituted by two side frames 11, each of which has a substantially h-shaped side surface so that only a lower half portion of each of the side frames 11 is made wide, and several cross frames 12 transversely connecting the two side frames 11. The cover body portion 2 is made of hard synthetic resin so as to cover the whole of the body portion 1 on its front surface. A vertically-long rectangular cavity portion 21 is formed in the front upper half portion of the cover body portion 2 so as to be able to house the bed portion B therein (see FIG. 2).

One of the several cross frames 12 which is provided in the rear of the bed portion B (further described below) has not only function to act as a connecting rod or frame member between the two side frames 11, but also acts as a support rod (e.g., act as a stop) for maintaining the bed portion B horizontal when the bed portion B is in a horizontally extended state. That is, when the bed portion B is horizontally extended (in use), the lower end portion of the bed portion B abuts on the lower surface of the cross frame 12 provided in the rear of the bed portion B, so that the top end portion of the bed portion B is limited or stopped by the cross frame 12 so as not to further fall. Accordingly, the bed portion B can be stably maintained in the horizontally extended state (see FIG. 5).

The bed portion B is made of hard synthetic resin or the like, similar to the cover body portion 2 and formed so as to have a size so that the bed portion B can be pivotally fitted into the vertically-long rectangular cavity portion 21 formed in the cover body portion 2. Pivotal shafts 31 are provided so as to project outwards from the opposite side portions of the bed portion B near the lower end portion of the same so that the pivotal shafts 31 are pivoted in the side frames 11, respectively. Thus, the bed portion B can be pivoted relative to the frame body portion A so as to be selectively vertically folded or horizontally extended.

A position or posture maintaining spring 4 is provided so as surely to maintain a posture of the bed portion B in the vertically folded or housed state and the horizontally extended or in-use state. The spring 4 is always urged so as to be able to generate bias force in the case where the bed portion B is vertically folded or horizontally extended.

The above posture maintaining spring 4 is engaged at its upper end portion with a support shaft 13 projected inward from the side frames 11 at its upper end portion, and the lower end portion of the spring 4 is engaged with one of support shafts 32 provided on the bed portion B and projecting outward therefrom at the opposite sides of the lower end portion thereof.

Figure 5:
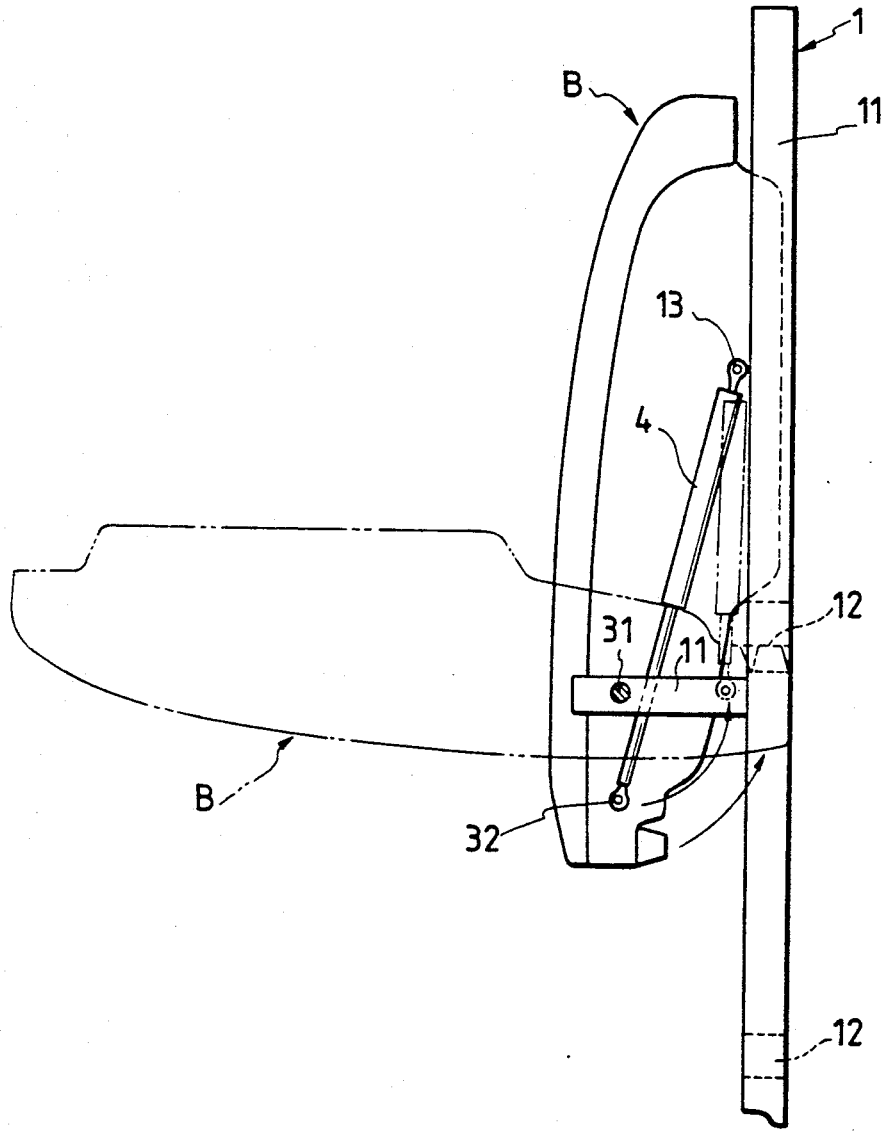
FIG. 5 is a side view showing the main portion of FIG. 4.

As shown by way of example in FIGS. 4 and 5, it is necessary that the positions where the support shafts 32 are projected outward from the opposite sides of the bed portion B at the lower end portion thereof, are selected so as to be lower than the positions where the pivotal shafts 31 are projected outward and are offset with respect to a centerline of portion B such that the spring will not contact or otherwise obstruct the pivotal shafts 31 as the bed portion is vertically folded or horizontally extended.

If such positions are selected for the support shafts 32, then when the bed portion B is in the vertically folded state, that is, in the housed state as shown by solid lines in FIG. 5, the bias force of the spring 4 acts so as to raise the lower end front portion of the bed portion B upward so that the bed portion B does not fall or become horizontally extended. Thus, the bed portion B can be surely maintained in the housed state. On the other hand, in the case where the bed portion B is in the horizontally extended or in-use state as shown by two-dotted chain lines in FIG. 5, the bias force of the spring 4 acts so as to raise the rear end portion of the bed portion B, so that the bed portion B can be surely maintained in the horizontally extended state.

Figure 1:
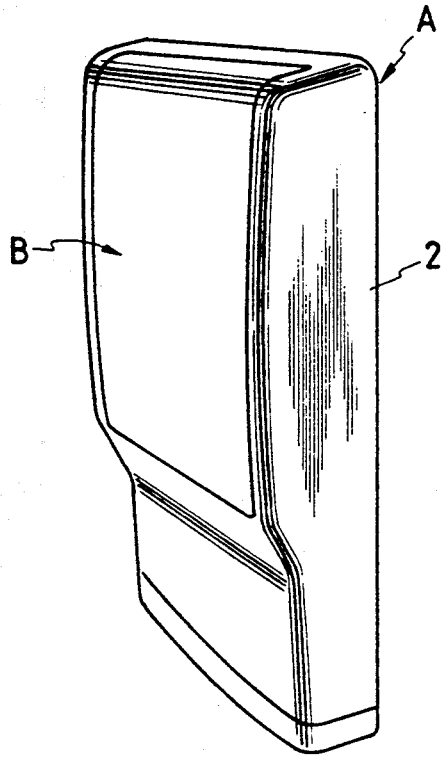
FIG. 1 is a perspective view of an embodiment of the folding baby bed according to the present invention in a state where the bed portion is folded so as to be housed in the frame body portion.
Figure 2:
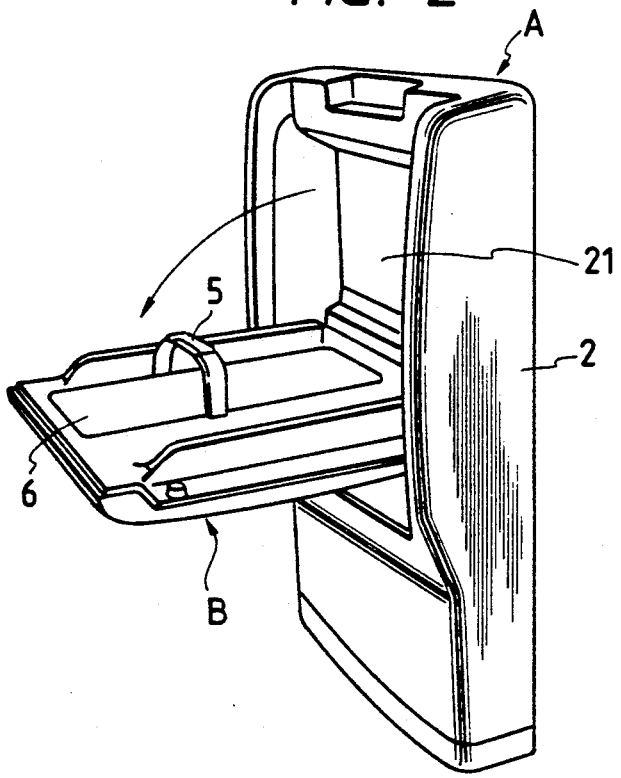
FIG. 2 is a perspective view showing the same folding baby bed in a state where the bed portion is drawn out from the housing frame body portion so as to be horizontally extended from the state shown in FIG. 1.
Figure 3:
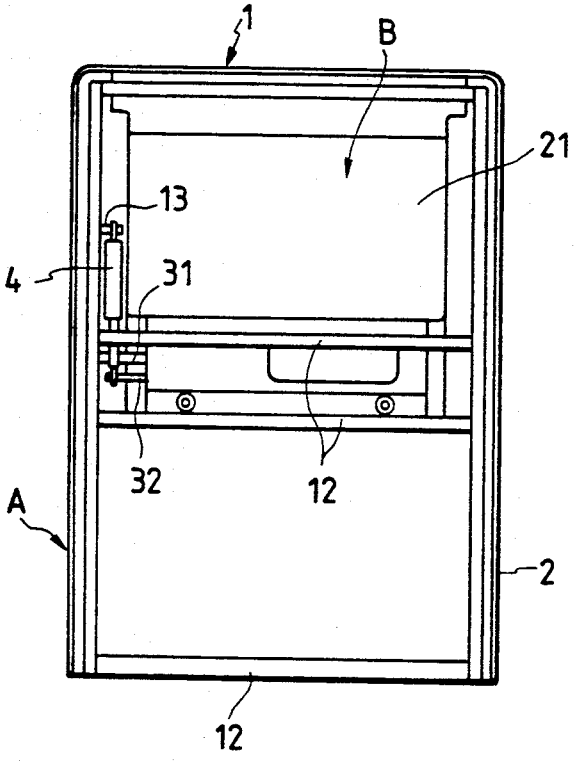
FIG. 3 is a back view of the folding baby bed of FIG. 1.

As shown in FIG. 2, belts 5 are provided on the bed portion B for use in securing and confining a movement of a baby laid down on the bed portion B, thereby to prevent an unforeseen accident from occurring.

It is preferable to stick a pad made of a soft material such as urethane foam on the surface of the bed portion B.

The folding baby bed according to the present invention having such a configuration as described above provides advantageous effects as follows.

(1) The housing frame body portion A and the bed portion B are provided in combination so that the bed portion B can be vertically folded so as to be housed in the housing frame body portion, or horizontally extended in use. The housing frame body portion A can be attached to a wall surface or the like in a lavatory or toilet room in a position such that the bed portion B is made to stand against the wall surface or the like. Accordingly, the folding baby bed can be compactly provided in the lavatory or toilet room or the like According to the present invention, the bed portion B can be retracted into and housed in the housing cavity portion 21 formed in the housing frame body portion A when the bed portion B is not in use, so that the area to be occupied by the bed in the room can be reduced. Accordingly, the disadvantages in conventional equipment such as a baby circle, etc., can be completely eliminated.

(2) The baby bed is structured so that the portion B housed in the housing frame body portion A can be horizontally extended with a simple handling operation. Accordingly, even persons having little technical knowledge can easily use the baby bed without special explanation as to the baby bed.

(3) The baby laid down on the bed portion B is safely held by means of the belt 5 or the like, so that the diaper or clothes of the baby can be easily exchanged.

(4) Since the bed portion B is attached to the housing frame body portion A at a longitudinally central portion of the latter, a mother or any other person who is going to change the diaper or clothes of a baby can perform her operation while she is standing in a reasonable and natural physical condition.

We claim:

1. A folding baby bed comprising:

a body portion having side and cross frame members and a cavity formed in a front upper half portion thereof;

a bed portion pivotally attached to at least one of said side frame members through pivotal shafts projected from said bed portion at opposite end portions thereof and in a vicinity of a lower end portion thereof, so that said bed portion is able to be vertically folded and horizonally extended, said bed portion having a base end portion which abuts on at least one of said cross frame members so that said bed portion is maintained in a horizontal state when said bed portion is horizontally extended, said bed portion being housed in said cavity portion formed in said body portion when said bed portion is in a vertically folded state; and posture maintaining urging means coupled to said body portion and said bed portion, for applying a bias force such that when said bed portion is vertically folded, the applied bias force maintains said bed in said vertically folded state.

2. A folding baby bed according to claim 1, in which said urging means comprises spring means for applying the bias force, said spring means being supported by a first support shaft connected to at least one of said side frame members of said body portion and a second support shaft connected to said bed portion, at a portion spaced from said pivotal shafts such that said spring means does not confront said pivotal shafts when said bed portion is selectively vertically folded and horizontally extended.

3. A folding body bed according to claim 2, wherein said second support shaft is located in a position lower than said pivotal shafts and displaced from the center of said bed portion.

4. A folding baby bed comprising:

a body portion having side and cross frame members and a cavity formed in a front upper half portion thereof;

a bed portion pivotally attached to at least one of said side frame members through pivotal shafts projected from said bed portion at opposite end portions thereof and in a vicinity of a lower end portion thereof, so that said bed portion is able to be vertically folded and horizontally extended, said bed portion having a base end portion which abuts on at least one of said cross frame members so that said bed portion is maintained in a horizontal state when said bed portion is horizontally extended, said bed portion being housed in said cavity portion formed in said body portion when said bed portion is in a vertically folded state; and posture maintaining urging means coupled to said body portion and said bed portion, for applying a bias force such that when said bed portion is horizontally extended, the applied bias force maintains said bed in said horizontally extended state.

* * * * *